US010267057B2

(12) United States Patent
Goodrich et al.

(10) Patent No.: US 10,267,057 B2
(45) Date of Patent: Apr. 23, 2019

(54) FENCE SLAT AND FENCE SLAT LOCKING SYSTEM

(71) Applicant: Creedmoor Holdings, LLC, Lehi, UT (US)

(72) Inventors: Kenneth Goodrich, Lehi, UT (US); Zane Mitchell, Lehi, UT (US)

(73) Assignee: Creedmoor Holdings, LLC, Lehi, UT (US)

( * ) Notice: Subject to any disclaimer, the term of this patent is extended or adjusted under 35 U.S.C. 154(b) by 0 days.

(21) Appl. No.: 15/060,783

(22) Filed: Mar. 4, 2016

(65) Prior Publication Data

US 2017/0254110 A1 Sep. 7, 2017

(51) Int. Cl.
*E04H 17/16* (2006.01)
*E04H 17/14* (2006.01)

(52) U.S. Cl.
CPC ..... *E04H 17/16* (2013.01); *E04H 17/1417* (2013.01); *E04H 17/1426* (2013.01); *E04H 17/168* (2013.01); *E04H 2017/1452* (2013.01)

(58) Field of Classification Search
CPC ..... E04F 11/1851; E04F 11/1857; E04F 2201/0115; E04F 2201/013; E04F 2201/0146; E04H 17/1421; E04H 17/1426; E04H 17/16; E04H 17/168; E04H 17/20; E04H 2017/1452
USPC ..... 256/33, 66, 73
See application file for complete search history.

(56) References Cited

U.S. PATENT DOCUMENTS 2,358,415 A * 9/1944 Plante ..... E04B 2/721 220/689
3,234,700 A * 2/1966 Creveling ..... E04C 2/08 52/284
3,267,626 A * 8/1966 Daly ..... E04C 2/08 52/145
3,290,850 A * 12/1966 Byrne, Jr. ..... E04C 2/54 160/235
3,799,506 A * 3/1974 Schwartz ..... E04H 17/1408 256/24
4,188,019 A * 2/1980 Meredith ..... E04F 11/181 256/24
4,223,503 A * 9/1980 Hague ..... E04D 3/38 52/394
4,266,385 A * 5/1981 Oehlert ..... E04D 3/362 52/521
4,573,300 A * 3/1986 Bezner ..... E04C 2/543 428/100
4,679,371 A * 7/1987 Jilken ..... E04C 3/005 52/574
5,078,530 A * 1/1992 Kim ..... E04D 3/366 403/24
5,140,793 A * 8/1992 Knudson ..... E04D 3/363 52/520

(Continued)

*Primary Examiner* — Josh Skroupa
*Assistant Examiner* — Cory B Siegert
(74) *Attorney, Agent, or Firm* — Travis R. Banta; TechLaw Ventures, PLLC

(57) ABSTRACT

A fence slat includes a first fence slat locking mechanism disposed on one side of the fence slat. The fence slat further includes a second fence slat locking mechanism disposed on a second side of the fence slat. A plurality of fence slats are interlocked with each other by the one or more locking mechanisms such that lateral tension is applied between each fence slat.

16 Claims, 5 Drawing Sheets

(56) References Cited

U.S. PATENT DOCUMENTS

| | | | | |
|---|---|---|---|---|
| 5,725,201 | A * | 3/1998 | Parth | E04C 2/20 160/235 |
| 6,260,828 | B1 * | 7/2001 | English | E04H 17/168 256/21 |
| 7,316,749 | B2 * | 1/2008 | Smith | B05B 15/1214 118/326 |
| 8,210,503 | B2 * | 7/2012 | Garrison | E04H 17/16 256/24 |

* cited by examiner

FENCE SLAT AND FENCE SLAT LOCKING SYSTEM

BACKGROUND

1. Technical Field

This disclosure relates to fence slat and a fence slat locking system for a fence. More specifically, the fence slat and fence slat locking system described herein may be used to construct a fence with substantial rigidity, weather resistance, and durability. The resulting fence is attractive, customizable, and carries a substantially lower cost than conventional fences.

2. Description of the Related Art

Fences have been constructed to divide one section of land from another, protect animals, corral animals, and maintain physical boundaries since the concept of private property originated. Many types of fences have been constructed in that time including hedge fences (fences made from living plants—cactus, shrubs, trees, turf, and etc.); wood fences; metal fences; stone fences, concrete fences, or hybrid fences made from two or more of the foregoing types of materials. Examples of hybrid fences include barbwire fences which string metal wire between wooden braces and along one or more steel poles designed to hold the metal wire in place at a certain height. Another example includes a stake fence in which wooden stakes are driven into the ground that are wrapped one to another with metal wire.

More recently, various manmade materials have been used to construct fences. For example, temporary fences have been manufactured from various plastics. Construction sites, ski runs, and even roadways typically use a plastic mesh fencing that that is stretched between one or more poles as a barricade to prevent people or animals from accessing a certain area. Other plastics have been used to construct fences such as PVC (polyvinyl chloride), which are more commonly referred to as "vinyl" fences.

Vinyl fences are typically used in applications where the attractiveness of the fence is a concern because they are considered to be more attractive than many other types of fences at a substantially lower cost than those other types of fences. For example, many homeowners choose to build vinyl fences in residential applications to separate one home from another. Corrals that house fine animals may be built using vinyl fencing configured in a horse fence configuration, for example, in an effort to impress buyers or improve the perceived value of the animals. Other applications for vinyl fences include privacy fencing, pool fencing, and pet fencing.

Vinyl fencing, however, has a number of drawbacks. First, because vinyl fencing is typically subject to substantial heat and substantial cold in some geographic locations, vinyl fences have a tendency to expand when heated and contract when cooled. This daily expansion and contraction of vinyl fences as the fence slats are exposed to sun can be detrimental to the structural rigidity of the fence because PVC, the plastic from which vinyl is made, tends to have a relatively low memory compared to metal or wood fences, for example. The term "low memory" describes a situation in which the PVC that forms the vinyl fencing does not necessarily return to its original position and condition when it is heated and cooled. Over time, repeated heating and cooling causes additional play between fence slats, sagging between vertical support posts, and brittleness in the fencing materials. The corresponding structural rigidity of the fence is similarly compromised, allowing the fence to bend and move substantially. Not only does repeated heating and cooling make vinyl fences susceptible to damage caused by physical impacts (e.g. children throwing a ball at the fence) or weather, but also results in decreased attractiveness of the fence as sags begin to develop. Since vinyl fences are typically installed for aesthetic reasons, the decreased attractiveness of the fence over time is undesirable.

Second, a typical vinyl fence relies on plastic slats as structural components that increase the structural rigidity of a vinyl fence. Vinyl fence slats are typically disposed parallel to vertical support posts and are enclosed on both ends by horizontal beams. Tension between the slats on either side of a vertical support post is transferred into opposing forces that push on the vertical support post in opposing directions, which in turn provides structural rigidity to the fence. As the fence slats expand and contract as they are heated and cooled by the sun each day, the slats lose the tension between them, reducing the forces applied to the vertical support posts, and therefore reducing the structural rigidity of the fence.

Third, typical vinyl fences are not customizable on opposing sides of the vinyl fences. While manufacturers make vertical support posts, horizontal beams, and fence slats in various colors, both sides of the vinyl fence are constructed using the same color because conventional vinyl fence slats maintain the same color on both sides of a conventional vinyl fence slat. Since vinyl fences typically mark property boundaries, and color preferences between neighbors may be different, neighbors may often be unable to agree on a color for the vinyl fence.

Accordingly, it is one object of this disclosure to provide a fence slat locking system that maintains the structural rigidity of a fence over time. Another object of this disclosure is to provide a fence slat that locks together with one or more other fence slats to increase the structural rigidity of a fence.

Finally, it is another object of this disclosure to provide a fence slat locking system that is customizable on different sides of the fence.

SUMMARY

Disclosed herein is a fence slat. The fence slat includes a fence slat locking mechanism disposed on a first side of the fence slat. The fence slat further includes a fence slat locking mechanism disposed on a second side of the fence slat. Also disclosed herein is a fence slat locking system which includes a first fence slat, a second fence slat, a third fence slat, and a fourth fence slat. In the fence slat locking system, the second fence slat interlocks with the third fence slat. Each of the first fence slat, the second fence slat, the third fence slat, and the fourth fence slat may experience lateral tension when disposed between a first fence post and a second fence post.

BRIEF DESCRIPTION OF THE DRAWINGS

The accompanying drawings illustrate an embodiment of fence slat and fence slat locking system.

DETAILED DESCRIPTION OF PREFERRED EMBODIMENTS

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

Figure 1:
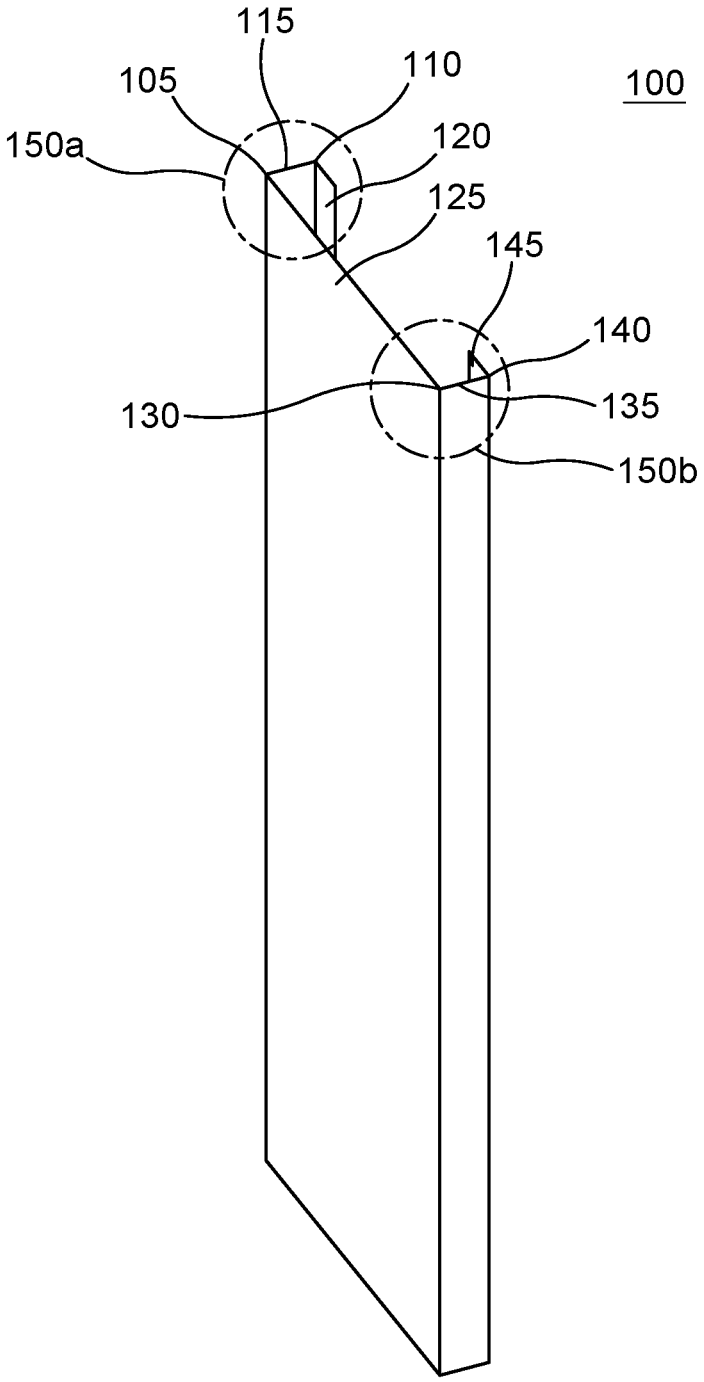
FIG. 1 illustrates a perspective view of a fence slat suitable for use in a fence slat locking system disclosed herein.

FIG. 1 illustrates a perspective view of a fence slat 100 suitable for use in a fence slat locking system. Fence slat 100 is typically constructed using metals and metal alloys. In one embodiment, fence slat 100 is constructed using steel. However, fence slat 100 could be implemented using any metal with tensile properties suitable for use as a fence slat. For example, fence slat 100 may be constructed from other metals such as tin, aluminum, magnesium, beryllium, and alloys that include any of these metals. Typically, fence slat 100 may be constructed from metals that are between 0.005 and 0.100 inches in thickness. However, in some implementations, fence slat 100 may require a thicker or thinner metal. Because fence slat 100 is constructed using a metal, fence slat 100 enhances the structural rigidity of a fence over time over conventional vinyl slats. Fence slat 100, constructed using a metal, is less susceptible to heat induced expansion and contraction and sagging over time.

Fence slat 100 includes a first bend 105 and a second bend 110 which create a first locking surface 115 and a second locking surface 120. First bend 105, second bend 110, first locking surface 115, and second locking surface 120 are referred to as first fence slat locking mechanism 150*a*. First fence slat locking mechanism 150*a* is created by creating first bend 105 in fence slat 100. Fence slat 100 is bent along an entire length of fence slat 100 such that first locking surface 115 is substantially perpendicular to a face 125 of fence slat 100. First bend 105 is ideally a 90° bend (relative to face 125 of fence slat 100) and is generally within 10° of 90° in ideal implementations. However, as will be discussed below, first bend 105 may be implemented as a bend between about 30° and about 150° in order to facilitate the locking of fence slat 100 with another fence slat.

In first fence slat locking mechanism 150*a*, first locking surface 115 is ideally perpendicular to face 125 of fence slat 100 and is typically between 0.25 and 3 inches in length, depending on the particular implementation of fence slat 100. A length of first locking surface 115 is defined as being the surface of fence slat 100 disposed between first bend 105 and second bend 110. Second bend 110 is also ideally a 90° bend (relative to first bend 105) and is generally within 10° of 90° in ideal implementations. However, as will be discussed below, second bend 110 may implemented as a bend between about 30° and about 150° in order to facilitate the locking of fence slat 100 with another fence slat. Second bend 110 defines a second locking surface 120 that is substantially perpendicular to first locking surface 115 and substantially parallel with face 125 of fence slat 100. A width of second locking surface 120 may be less than half of the width of fence slat 100 across face 125 of fence slat 100. In other words, if the width of fence slat 100 measures 8 inches from third bend 130 (which will be discussed below) to first bend 105, the length of second locking surface 120 is less than 4 inches.

Fence slat 100 includes a third bend 130 and a fourth bend 140 which create a third locking surface 135 and a fourth locking surface 145. Third bend 130, fourth bend 140, third locking surface 135, and fourth locking surface 145 are referred to as second fence slat locking mechanism 150*b*. Second fence slat locking mechanism 150*b* is disposed on a side of fence slat 100 that is opposite of first fence slat locking mechanism 150*a* (i.e., first fence slat locking mechanism 150*a* is disposed on a first side of fence slat 100 while second fence slat locking mechanism 150*b* is disposed on a second side of fence slat 100 opposite of the first side of fence slat 100). Second fence slat locking mechanism 150*b* is created by creating third bend 130 in fence slat 100. Fence slat 100 is bent along an entire length of fence slat 100 such that the third locking surface 135 is substantially perpendicular to a face 125 of fence slat 100. Third bend 130 is ideally a 90° bend (relative to face 125 of fence slat 100) and is generally within 10° of 90° in ideal implementations. However, as will be discussed below, third bend 130 may be implemented as a bend between about 30° and about 150° in order to facilitate the locking of fence slat 100 with another fence slat.

In second fence slat locking mechanism 150*b*, third locking surface 135 is ideally perpendicular to face 125 of fence slat 100 and is typically between 0.25 and 3 inches in length, depending on the particular implementation of fence slat 100. A width of third locking surface 135 is defined as being the surface of fence slat 100 disposed between third bend 130 and fourth bend 140. Fourth bend 140 is also ideally a 90° bend and is generally within 10° of 90° in ideal implementations. However, as will be discussed below, fourth bend 140 may be implemented as a bend between about 30° and about 150° in order to facilitate the locking of fence slat 100 with another fence slat. Fourth bend 140 defines a fourth locking surface 145 that is substantially perpendicular to third locking surface 135 and substantially parallel with face 125 of fence slat 100. A width of fourth locking surface 145 may be less than half of the width of fence slat 100 across face 125 of fence slat 100. In other words, if the width of fence slat 100 measures 8 inches from third bend 130 to first bend 105, the length of fourth locking surface 145 is less than 4 inches.

Each of first bend 105, second bend 110, third bend 130, and fourth bend 140 may be implemented along substantially the entire length of fence slat 100. In other words, if a length of fence slat 100 is measured as 6 feet from a top of fence slat 100 to a bottom of fence slat 100, first bend 105, second bend 110, third bend 130, and fourth bend 140 may also be 6 feet in length from the top of fence slat 100 to the bottom of fence slat 100. The exemplary widths and lengths of fence slat 100 described above are not limiting and are merely disclosed for the purposes of explanation, description, and example. Different slats, including those that incorporate different aesthetic designs, for example, may be implemented with any dimensions of length and width.

Figure 2:
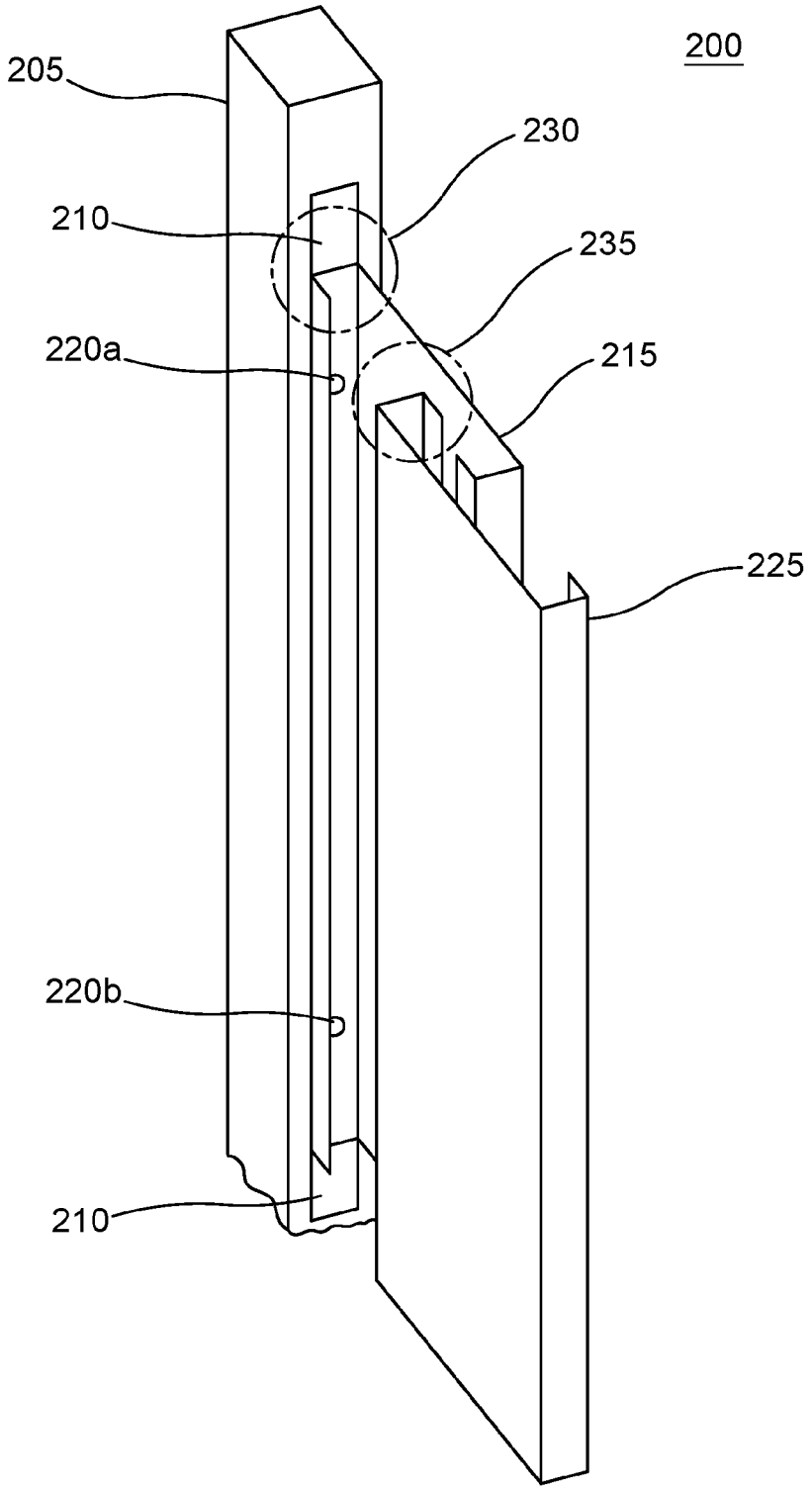
FIG. 2 illustrates a perspective view of one embodiment of the fence slat locking system.

FIG. 2 illustrates a perspective view of one embodiment of fence slat locking system 200. Fence slat locking system 200 includes a fence post 205. Fence post 205 may be constructed using any suitable materials. For example, fence post 205 may be constructed using a metal or metal alloy, wood, or plastic, such as polyvinyl chloride. Fence post 205 may include two apertures 210 for receiving a horizontal support, which will be discussed in more detail below.

Fence slat locking system 200 further includes a first fence slat 215, which is similar in description and implementation to fence slat 100, shown in FIG. 1. First fence slat 215 may be attached to fence post 205 using any fastener known in the art. For example, in one implementation, first fence slat 215 may be attached to fence post 205 using one or more self-tapping screws. Shown in FIG. 2 are first attachment point 220*a* and second attachment point 220*b* which are shown merely for purposes of explanation and description. Any number of attachment points may be implemented in fence slat locking system 200.

Once first fence slat 215 is attached to fence post 205, a second fence slat 225 may be installed in fence slat locking system 200. Second fence slat 225 is also similar in description and implementation to fence slat 100, shown in FIG. 1. First fence slat 215 includes a first locking mechanism 230 which is similar in description and implementation to second fence slat locking mechanism 150*b*, shown in FIG. 1. Second fence slat 225 includes a second locking mechanism 235 which is similar in description and implementation to first fence slat locking mechanism 150*a*, shown in FIG. 1. In FIG. 2, second locking mechanism 235 of second fence slat 225 is inserted into first locking mechanism 230 of first fence slat 215. When assembled, second locking mechanism 235 of second fence slat 225 nests inside first locking mechanism 230 of first fence slat 215. First locking mechanism 230 of first fence slat 215 may exert tension on second locking mechanism 235 of second fence slat 225 such that second fence slat 225 may be secured in place while additional fence slats are installed. The further installation of fence slats will be discussed below.

Figure 3:
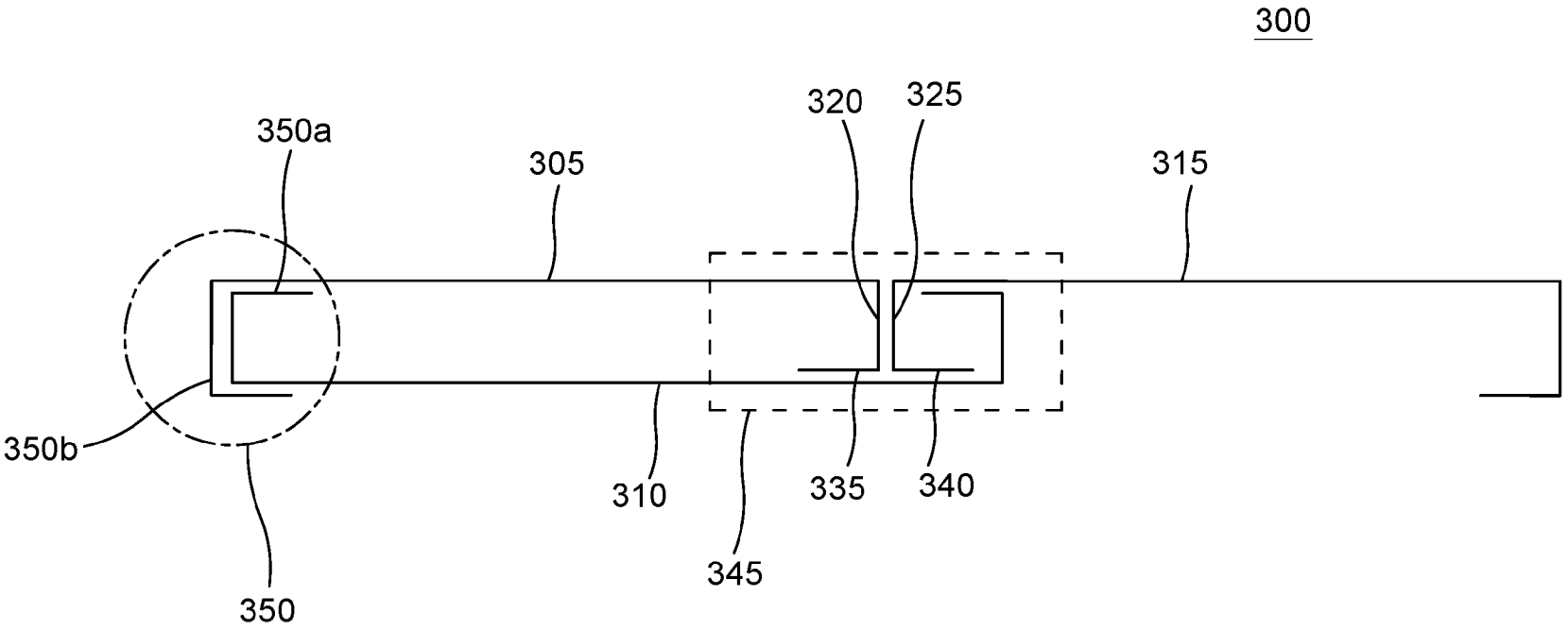
FIG. 3 illustrates a top view of one embodiment of the fence slat locking system.

FIG. 3 illustrates a top view of one embodiment of fence slat locking system 300. Fence slat locking system 300 includes first fence slat 305, second fence slat 310, and third fence slat 315. Each of first fence slat 305, second fence slat 310, and third fence slat 315 are similar in implementation and description to fence slat 100, shown in FIG. 1. First fence slat 305 includes first locking surface 320 and second locking surface 335. First locking surface 320 abuts third locking surface 325 of third fence slat 315 such that first locking surface 320 may be held to third locking surface 325 of third fence slat 315. Third fence slat 315 further includes a fourth locking surface 340 which secures second fence slat 310 to third fence slat 315. More simply put, fourth locking surface 340 of third fence slat 315 secures third fence slat 315 to second fence slat 310 by interlocking a locking mechanism of third fence slat 315 with a locking mechanism of second fence slat 310.

Accordingly FIG. 3 illustrates a three fence slat interlocking system 345 in which first fence slat 305, second fence slat 310, and third fence slat 315 are interlocked by their various locking mechanisms interlocking in three fence slat interlocking system 345. Fence slat locking system 300 creates an implementation in which, for example, first fence slat 305 includes a first locking mechanism 350*b* which may be attached to a fence post while second fence slat 310 includes a second locking mechanism 350*a* which may be nested into first locking mechanism 350*b* to create a two fence slat interlocking mechanism 350. At the same time, third fence slat 315 may be indirectly secured to first fence slat 305 by directly securing third fence slat 315 to second fence slat 310. Accordingly, fence slat locking system 300 may include both two fence slat interlocking mechanism 350 and three fence slat interlocking mechanism 345.

Figure 4:
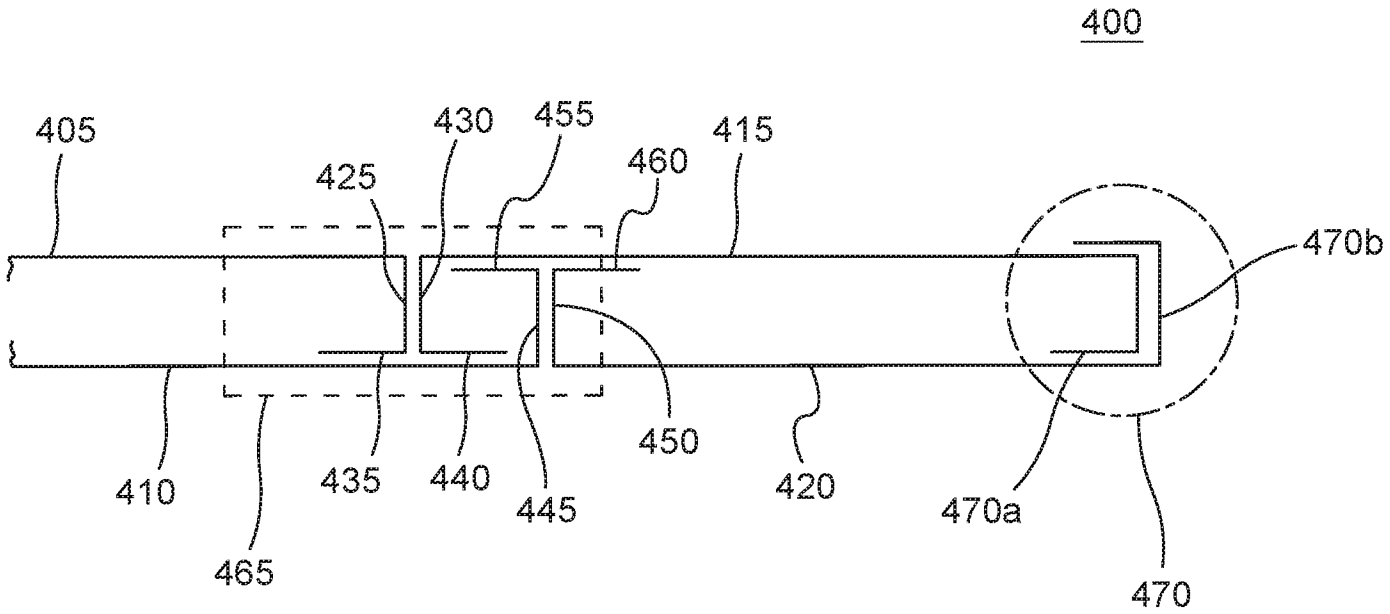
FIG. 4 illustrates a top view of one embodiment of the fence slat locking system.

FIG. 4 illustrates a top view of one embodiment of fence slat locking system 400. Fence slat locking system 400 includes first fence slat 405, second fence slat 410, third fence slat 415, and fourth fence slat 420. Each of first fence slat 405, second fence slat 410, third fence slat 415, and fourth fence slat 420 are similar in implementation and description to fence slat 100, shown in FIG. 1. First fence slat 405 includes first locking surface 425 and second locking surface 435. First locking surface 425 of first fence slat 405 abuts third locking surface 430 of third fence slat 415 such that first locking surface 425 may be held to third locking surface 430 of third fence slat 415. Third fence slat 415 further includes a fourth locking surface 440 which secures second fence slat 410 to third fence slat 415 by interlocking fourth locking surface 440 with fifth locking surface 445 and sixth locking surface 455 of second fence slat 410. As shown in FIG. 4, fifth locking surface 445 and sixth locking surface 455 of second fence slat 410 interlock with third locking surface 430 and fourth locking surface 440 to ensure that second fence slat 410 and third fence slat 415 are held together in fence locking system 400.

As mentioned above, fence locking system 400 includes fourth fence slat 420 which further includes seventh locking surface 450 and eighth locking surface 460. In fence locking system 400, seventh locking surface 450 abuts fifth locking surface 445 such that seventh locking surface 450 may be held to fifth locking surface 445 of second fence slat 410. In this manner, four fence slats may be arranged together in a locking manner.

Accordingly, FIG. 4 illustrates a four fence slat interlocking system 465 in which first fence slat 405, second fence slat 410, third fence slat 415, and fourth fence slat 420 are interlocked by their various locking mechanisms interlocking in four fence slat interlocking system 465. Fence slat locking system 400 creates an implementation in which, for example, fourth fence slat 420 includes a first locking mechanism 470*b* which may be attached to a fence post while third fence slat 415 includes second locking mechanism 470*a* which may be nested into first locking mechanism 470*b* to create a two fence locking mechanism 470. At the same time, second fence slat 410 may be indirectly secured to fourth fence slat 420 by directly securing second fence slat 410 to third fence slat 415.

In this manner, additional fence slats may be installed in a section of fence using the techniques described herein. For example, once first fence slat 405, second fence slat 410, third fence slat 415, and fourth fence slat 420 have been interlocked in four fence slat interlocking system 465 (and third fence slat 415 and fourth fence slat 420 have been interlocked in two fence locking mechanism 470), additional fence slats may be successively added to create a plurality of four fence slat interlocking systems 465. As additional fence slats are successively added and additional four fence slat interlocking systems 465 are created, lateral tension is applied between various fence slats. This lateral tension applied between the various fence slats pushes abutting fence slats against each other, creating rigidity for a section of fence between fence posts. For example, first fence slat 405 may abut third fence slat 415 and receive lateral tension from third fence slat 415 and one or more other fence slats in a fence that are interlocked using the techniques described herein. Accordingly, four fence slat interlocking systems 465 enhance the rigidity of a section of fence using the techniques described herein over conventional fences.

Finally, fence slat locking system 400 may be customizable to suit a particular homeowner's aesthetic desires. In one embodiment, for example, first fence slat 405 and third fence slat 415 may share a common color scheme while second fence slat 410 and fourth fence slat 420 may share a common color scheme that is different from the color scheme shared by first fence slat 405 and third fence slat 415. More simply put, fence slats on opposite sides of fence slat locking system 400 may be differently colored. Thus, in a fence built between two adjacent properties, one property owner may enjoy one color fence while his neighbor may enjoy another color fence. To clarify, every slat in fence slat locking system 400 may be a different color. It is not required that every slat on one side of the fence maintain a particular color. This ability to customize the aesthetic design of the fence is desirable because different adjacent property owners may have different aesthetic tastes that are more easily satisfied by fence locking system 400 than conventional fences.

Figure 5:
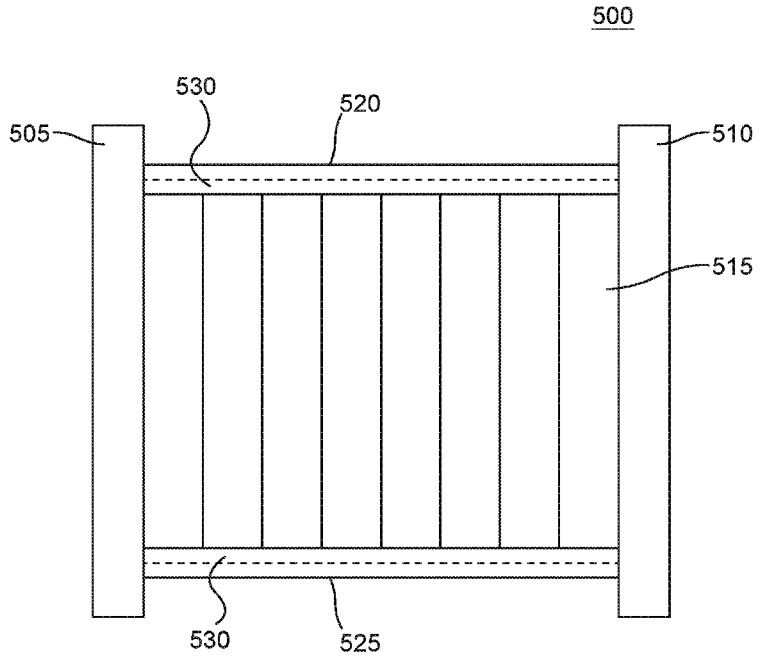
FIG. 5 illustrates a side view of a section of fence constructed using the fence slat and the fence slat locking system.

FIG. 5 illustrates a side view of a section of fence 500 constructed using fence slat 100 shown in FIG. 1 and one or more of fence slat locking systems 200, 300 and 400, shown in FIGS. 2, 3, and 4, respectively. Fence 500 is constructed between first fence post 505 and second fence post 510, which may be constructed using polyvinyl chloride plastic, and includes a plurality of fence slats 515 which are each interlocked as described above with respect to FIG. 2, FIG. 3, and FIG. 4. The plurality of fence slats 515 are disposed within a top horizontal cross member 520 and a bottom horizontal cross member 525 which provide horizontal support to fence 500. Top horizontal cross member 520 may be inserted into an aperture within first fence post 505 and second fence post 510 corresponding to aperture 210, shown in FIG. 2. Similarly, bottom horizontal cross member 525 may be inserted into another aperture within first fence post 505 and second fence post 510 also corresponding to aperture 210, shown in FIG. 2.

Both bottom horizontal cross member 525 and top horizontal cross member 520 may be constructed using polyvinyl chloride plastic and include a channel 530 of appropriate dimension to receive a top or bottom of the plurality of fence slats 515 such that at least a portion of each fence slat in the plurality of fence slats 515 are disposed within channel 530 of bottom horizontal cross member 525 and top horizontal cross member 520. In practice, bottom horizontal cross member 525 may be installed between first fence post 505 and second fence post 510 before the plurality of fence slats 515 are inserted into channel 530 of bottom horizontal cross member 525. Each of the plurality of fence slats 515 may be installed and interlocked described using the techniques described herein. Once the plurality of fence slats 515 are installed in an interlocking fashion, top horizontal cross member 520 may be installed by inserting the plurality of fence slats 515 into channel 530 of top horizontal cross member 520 while simultaneously inserting top horizontal cross member 520 into an aperture of first fence post 505 or second fence post 510. Top horizontal cross member 520 may then be slid across the top of the plurality of fence slats 515 into a corresponding aperture of first fence post 505 or second fence post 510. Fence 500 may therefore be completed.

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A plurality of fence slats, comprising:
a first fence slat,
a second fence slat,
a third fence slat, and
a fourth fence slat,
wherein each of the first fence slat, the second fence slat, the third fence slat, and the fourth fence slat include:
a first fence slat locking mechanism disposed on a first side of the respective fence slat, the first fence slat locking mechanism including a first bend and a second bend wherein the first bend defines a first locking surface and the second bend defines a second locking surface and wherein the second locking surface is substantially perpendicular to the first locking surface, and
a second fence slat locking mechanism disposed on a second side of the respective fence slat, the second fence slat locking mechanism including a third bend and a fourth bend wherein the third bend defines a third locking surface and the fourth bend defines a fourth locking surface and wherein the fourth locking surface is substantially perpendicular to the third locking surface, and
wherein the first fence slat, the second fence slat, the third fence slat, and the fourth fence slat are interlocked in a position in which the first locking surface of the first fence slat abuts the third locking surface of the third fence slat and the first locking surface of the second fence slat abuts the third locking surface of the fourth fence slat and
wherein the second locking surfaces of the first fence slat, the second fence slat, the third fence slat, and the fourth fence slat and the fourth locking surfaces of the first fence slat, the second fence slat, the third fence slat, and the fourth fence slat are bent at the respective second bend and the respective fourth bend towards each other and there terminate.

2. The fence slat of claim 1, wherein:
the first bend is 80-100° relative to a face of the fence slat,
the second bend is 80-100° relative to the first bend,
the first locking surface is disposed between the first bend and the second bend, and
the second locking surface is created by the second bend, the second locking surface being less than half of the width of the fence slat across the face of the fence slat.

3. The fence slat of claim 1, wherein the first locking surface is disposed between the first bend and the second bend.

4. The fence slat of claim 3, wherein the second locking surface is created by the second bend, wherein the second locking surface is less than half of the width of the fence slat across a face of the fence slat.

5. The fence slat of claim 1, wherein:

the third bend is 80-100° relative to a face of the fence slat, the fourth bend is 80-100° relative to the third bend, the third locking surface is disposed between the third bend and the fourth bend, and the fourth locking surface is created by the fourth bend, the fourth locking surface being less than half of the width of the fence slat across the face of the fence slat.

6. A fence slat locking system, comprising:

a first fence slat including a first locking surface and a second locking surface defined by a first bend and a second bend and a third locking surface and a fourth locking surface defined by a third bend and a fourth bend abutting a third fence slat including a first locking surface and a second locking surface defined by a first bend and a second bend and a third locking surface and a fourth locking surface defined by a third bend and a fourth bend;

a second fence slat including a first locking surface and a second locking surface defined by a first bend and a second bend and a third locking surface and a fourth locking surface defined by a third bend and a fourth bend interlocking with the first locking surface and the second locking surface of the third fence slat; and a fourth fence slat including a first locking surface and a second locking surface defined by a first bend and a second bend and a third locking surface and a fourth locking surface defined by a third bend and a fourth bend abutting the second fence slat, wherein faces of the first fence slat and the third fence slat are co-planar and faces of the second fence slat and the fourth fence slat are co-planar, and wherein the second locking surfaces of the first fence slat, the second fence slat, the third fence slat, and the fourth fence slat and the fourth locking surfaces of the first fence slat, the second fence slat, the third fence slat, and the fourth fence slat are bent at the respective second bend and the respective fourth bend towards each other and there terminate.

7. The system of claim 6, wherein the first fence slat abuts the third fence slat along at least one locking surface of the first fence slat and at least one locking surface of the third fence slat such that a face of the first fence slat is co-planar with a face of the third fence slat.

8. The system of claim 6, wherein the fourth fence slat abuts the second fence slat along at least one locking surface of the fourth fence slat and at least one locking surface of the second fence slat.

9. The system of claim 6, wherein the third fence slat nests within a locking mechanism of the fourth fence slat.

10. The system of claim 9, wherein the fourth fence slat is attached to a fence post.

11. The system of claim 6, wherein at least a portion of the first fence slat, the second fence slat, the third fence slat, and the fourth fence slat is disposed within a channel of a horizontal cross member.

12. The system of claim 11, wherein the horizontal cross member is disposed in an aperture of a first fence post and an aperture of a second fence post.

13. The system of claim 12, wherein the horizontal cross member is made of polyvinyl chloride plastic.

14. The system of claim 12, wherein the first fence post and the second fence post are made of polyvinyl chloride plastic.

15. The system of claim 6, wherein the first fence slat, the second fence slat, the third fence slat, and the fourth fence slat are made of metal.

16. The system of claim 6, wherein the first fence slat, the second fence slat, the third fence slat, and the fourth fence slat experience lateral tension between a first fence post and a second fence post.

* * * * *